US005143375A

United States Patent [19]

Wilkins

[11] Patent Number: 5,143,375

[45] Date of Patent: Sep. 1, 1992

[54] GOLF CLUB FINGER SUPPORT DEVICE

[76] Inventor: Judd R. Wilkins, 281 Littletown Quarter, Williamsburg, Va. 23185

[21] Appl. No.: 685,867

[22] Filed: Apr. 16, 1991

[51] Int. Cl.[5] ..... A63B 53/14

[52] U.S. Cl. ..... 273/81 D; 273/165; 273/81 C; 273/81.4

[58] Field of Search ..... 273/81 R-81 D, 273/165, 75, 81.2, 73 J, 75, 81.3-81.6

[56] References Cited

U.S. PATENT DOCUMENTS

| | | | |
|---|---|---|---|
| 1,075,054 | 10/1913 | Morley | 273/165 |
| 2,046,191 | 6/1936 | Smith | 273/81.4 |
| 2,321,773 | 6/1943 | Ruemelin | 273/81.2 |
| 2,710,190 | 6/1955 | Schimansky | 273/165 |
| 2,928,678 | 3/1960 | Cutting | 273/165 |
| 2,962,288 | 11/1960 | Lowden | 273/165 |
| 3,084,938 | 4/1963 | Kapanowski | 273/165 |
| 3,203,697 | 8/1965 | Berzatzy | 273/81 D |
| 3,256,023 | 6/1966 | Frazelle | 273/165 |
| 3,533,630 | 10/1970 | Monaco | 273/165 |
| 4,376,536 | 3/1983 | Martin | 273/81.4 |
| 4,781,382 | 11/1988 | Hargraves | 273/183 B |

FOREIGN PATENT DOCUMENTS

| | | | |
|---|---|---|---|
| 174490 | 2/1922 | United Kingdom | 273/165 |
| 322512 | 12/1929 | United Kingdom | 273/165 |
| 2031283 | 4/1980 | United Kingdom | 273/81 B |

OTHER PUBLICATIONS

Golf World, "Tommy Bolt's Super Grip", Aug. 26, 1977, p. 25.

*Primary Examiner*—V. Millin
*Assistant Examiner*—Steven B. Wong
*Attorney, Agent, or Firm*—Wallace J. Nelson

[57] ABSTRACT

An inverted L-shaped finger support device is releasably secured to the back side of a putter, or other golf club, shaft adjacent to the bottom area of the handle grip. The attachment device is formed of unitary, or hinged, cylindrical stock with the short arm of the inverted "L" extending perpendicular from the club shaft and adapted to be positioned between the index finger and the middle finger on the right hand of a golfer. The perpendicularly extending portion is disposed in the groove of the first joint of the golfer's index finger during use to thereby permit essentially the entire weight of the club to be supported with this one finger. Tap screws, bolts and a spring clip structure provide alternate releasable connections for securing the finger support device to a golf club. The spring clip releasable connection permits forced movement of the device along the length of the golf club to provide vertical adjustment thereof when the golfer desires to employ a choke grip on the golf club.

4 Claims, 2 Drawing Sheets

GOLF CLUB FINGER SUPPORT DEVICE

FIELD OF THE INVENTION

This invention relates to golf clubs in general and relates specifically to a finger support device for a golf putter that positions and supports key fingers on the putter during the putting stroke.

BACKGROUND OF THE INVENTION

The game of golf is a growing sport in this and other countries. Each participant in the sport strives to improve his game by reducing the number of strokes needed to play a round of golf. Assuming an eighteen hole golf course having a par rating of 72 strokes, and allowing two putts per hole, it is readily seen that at least fifty percent of the strokes during a round of golf can be expected to involve putting, or hitting the golf ball into the cup or hole with a putter. Any change in equipment or putting action that will serve to reduce the number of putts needed in playing a round of golf would, obviously, be of interest to most golfers.

In contrast to the golf swing with a driver or iron, where basic concepts are followed by most players, the art of putting is a very personal effort. Putting performance and style varies from person-to-person in putter selection, stance, position of hands and type of stroke employed. There is, however, general agreement in one area (with the exception of the elongated putters) and that is, the hand grip employed in putting. In contrast to the Vardon overlap grip used for other clubs, the putter is normally gripped with a reverse overlap. The right hand (for right hand golfers) grips the club first, then the left hand is positioned such that the index finger of the left hand extends down over the second, third, and little finger of the right hand. Both thumbs are positioned on top of the grip and point straight down the shaft with the palms facing each other. In individual preferences, the index finger of the right hand is extended and rests against the side of the shaft.

In the putting stroke, the first motion is to raise the putter head off the grass surface. At the same time, the putter is pulled back and forward with adequate force to move the ball toward the cup. Any untoward movement of the hands, body or head will pull the club head off the intended line of travel. Another critical area is the point at which the leading edge of the putter head strikes the golf ball. For example, if the ball is struck much below its equator, the ball will slide along the grass putting surface before it assumes the desired top spin roll. Such initial sliding of the ball will generally move the ball off the target line. To avoid this, the player must raise the putter 15 to 20 mm (⅝ to ¾") off the putting surface and maintain that distance during the putting stroke in order to hit near or slightly below the ball equator and produce the desired top spin.

It is an object of the present invention to provide a golf putter structure that places substantially the entire weight of the putter on one finger during a putting stroke to thereby permit better putter control and feel for the putting stroke.

Another object of the present invention is a putter structure that reduces the occurrence of the putter head inadvertently contacting the putting surface during a putting stroke before the putter contacts the golf ball.

A further object of the present invention is a finger support attachment for a golf club that improves the control and feel of the club during the golf swing.

An additional object of the present invention is a releasably secured finger support device for a golf putter that improves the control and feel of the putter during a putting stroke.

Another object of the present invention is a hinged, segmented, releasably secured, finger support attachment for a golf club.

SUMMARY OF THE INVENTION

According to the present invention, the foregoing and additional objects are attained by providing an inverted L-shaped finger support attachment device releasably attached to the back side of a golf club shaft adjacent to, or overlapping the bottom area of the handle grip. The attachment device is constructed from solid cylindrical material and may be of unitary or segmented construction. The unitary construction has a first cylindrical portion disposed parallel with a golf club shaft and an integral elbow, or ninety degree bend, at one end of the first cylindrical portion leading to an integral second cylindrical portion disposed perpendicular, or horizontally, relative to the first cylindrical portion and the club shaft. When the finger support attachment device is constructed from segmented parts, the elbow section is omitted and replaced by a hinge connection for the segmented parts. In the preferred embodiment, one or more connecting screws or bolts extend through the first cylindrical portion into the shaft of the golf club to releasably secure the attachment device to the club such that the second cylindrical portion is disposed adjacent to the end of the handle grip on the club.

In an alternate embodiment a spring clip is welded or otherwise conventionally secured to the first cylindrical portion of the finger support attachment device and is clipped to the club shaft adjacent the bottom of the handle grip or may be clipped directly to the handle grip.

In each embodiment, the second, or horizontal, cylindrical portion of the finger support attachment device is disposed in the groove formed at the first joint of the golfer's index finger during use. This index finger hooking engagement of the second cylindrical portion of the attachment device essentially supports the entire weight of the club with this one finger.

BRIEF DESCRIPTION OF THE DRAWINGS

A more complete appreciation of the invention and many of the attendant advantages thereof will be more readily apparent as the same becomes better understood by reference to the following detailed description when considered in reference to the accompanying drawings wherein.

DETAILED DESCRIPTION

Figure 1:
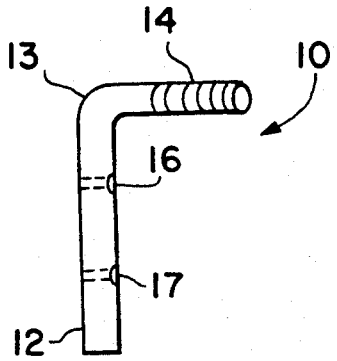
FIG. 1 is a view of the golf club finger support attachment device of the present invention prior to being releasably attached to a golf club.

Referring now to the drawings and more particularly to FIG. 1, the finger support attachment device of the present invention is shown and designated generally by reference numeral 10. In the preferred embodiment, attachment device 10 is formed of a unitary solid cylindrical metal bar shaped in an inverted L-configuration so as to have a first elongated cylindrical portion 12, an integral elbow portion 13, forming a ninety degree bend at one end of the first cylindrical portion 12 and, leading to an integral second cylindrical portion 14. Second cylindrical portion 14 of attachment device 10 is shorter than, and is disposed perpendicular to, first cylindrical portion 12. A pair of transverse openings 16,17 are provided in spaced relationship through first cylindrical portion 12. Openings 16,17 are disposed parallel to second cylindrical portion 14 and are provided with countersunk ends (not designated) on the surface of first cylindrical portion 12. Openings 16,17 serve to receive screws or bolts for releasably securing attachment device 10 to a golf club shaft, as will be further explained hereinafter.

Figure 2:
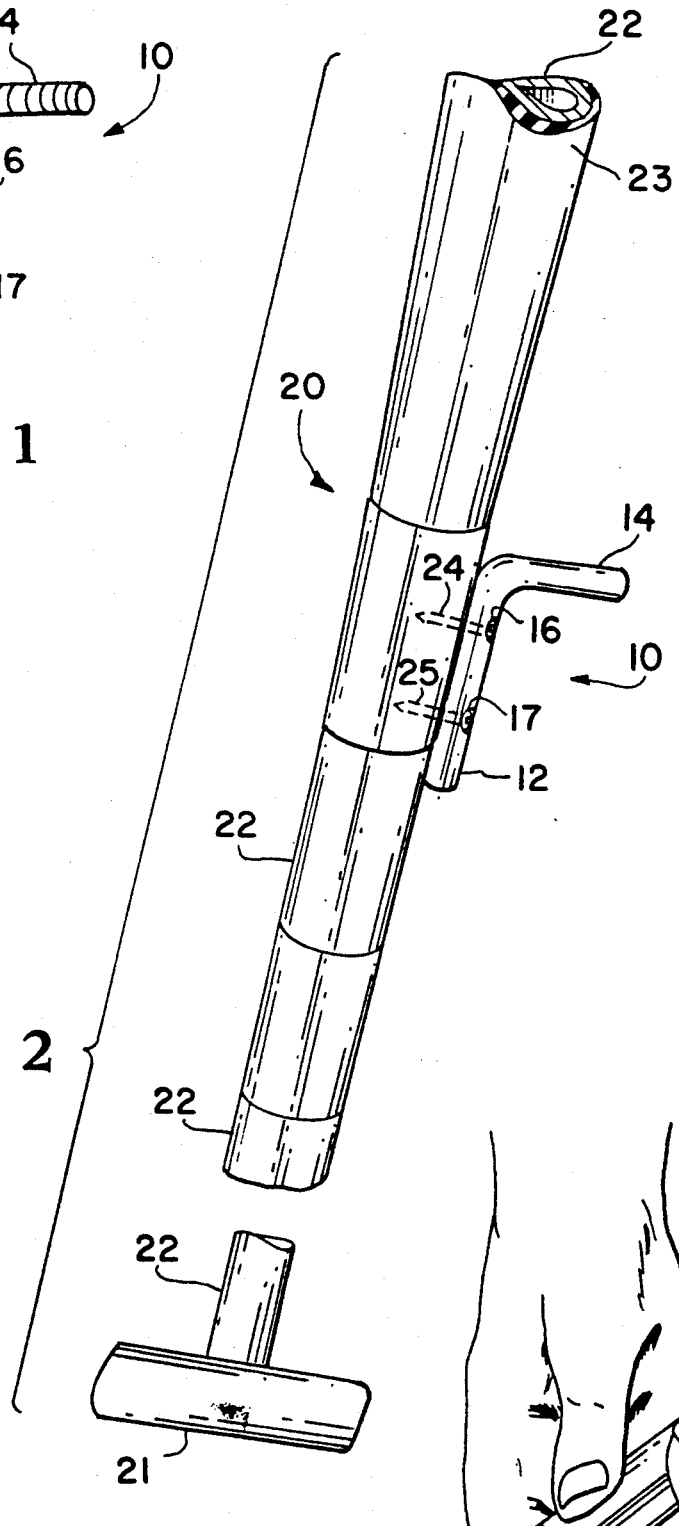
FIG. 2 is a view of the golf club device shown in FIG. 1 and illustrating one embodiment of the attachment structure for releasably securing the attachment device to a golf club, with the golf club being only partially shown.

Referring now to FIG. 2, a golf club 20 is illustrated with finger support attachment device 10 releasably secured thereto. As shown therein, golf club 20 is a putter having a putter head 21, a shaft 22, and a handle grip 23. Attachment device 10 is releasably secured to shaft 22 by a pair of tap screws 24,25 positioned in bores 16,17 and tapped into club shaft 22. When secured, as shown, first cylindrical portion 12 is disposed parallel to club shaft 22, elbow 13 is disposed adjacent handle grip 23 and second cylindrical portion 14 is perpendicular to shaft 22, on the back side of putter 20, and parallel with putter head 21. The heads of tap screws 24,25 are received within the countersunk ends of bores 16,17 to leave the head end of tap screws 24,25 flush with the exterior surface of first cylindrical portion 12.

Figure 3:
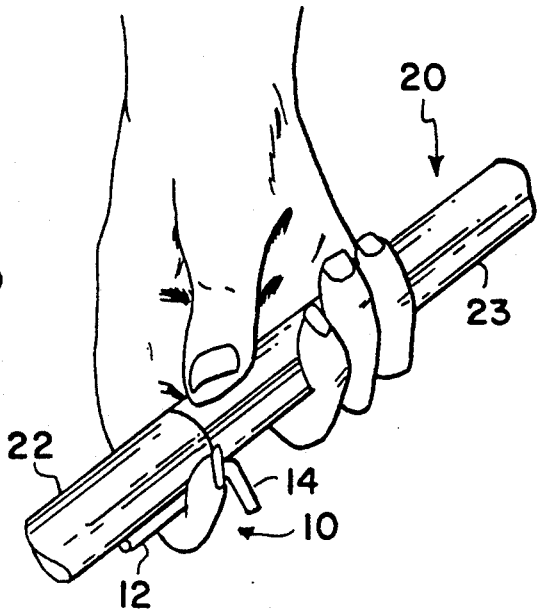
FIG. 3 is an illustration of the right hand grip employed with the golf club attachment device of the present invention.

Referring to FIG. 3, when putter 20 is in use the golfer positions his right hand such that the second cylindrical portion 14 is disposed between the first or index finger and the middle finger. The index finger is curled around shaft 22 and the first cylindrical portion 12 to position second cylindrical portion 14 resting within the groove formed at the first joint of the index finger. This positioning of the index finger thereby ensures that essentially the entire putter weight is supported by this one finger. Thus, the action of putter 20 can be effectively controlled by the support of the index finger of the user. By transferring much of the club weight from the hands to the fingers, the golfer assumes greater feel and control of the club, especially in lifting and maintaining the club off the ground through the putting stroke. The narrow cylindrical configuration of the cylindrical portions of finger support attachment device 10 fits the groove of the first joint of the index finger to provide a natural feeling to the hand grip.

Figure 4:
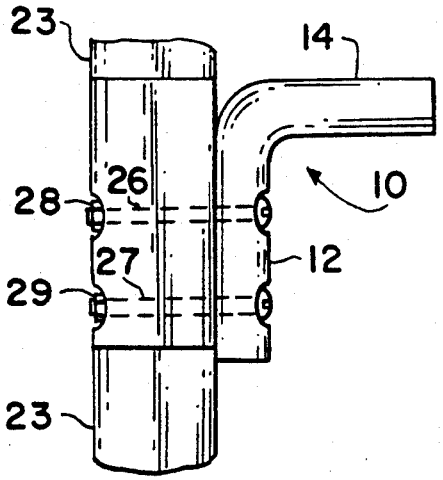
FIG. 4 is a view of an alternate attachment structure for releasably securing the attachment device to a golf club.

Referring to FIG. 4, an alternate embodiment of the releasable connection for finger support attachment device 10 is shown. In this embodiment a pair of threaded bolts 26,27 extend transversely through openings 16,17 of first cylindrical portion 12 and completely through club shaft 22. A pair of nuts 28,29, are disposed in countersunk openings in club shaft 22 to receive respective bolts 26,27. Nuts 28,29 may be permanently attached within the countersunk areas of club shaft 22, or they may be removable with bolts 26,27. In lieu of nuts 28,29 the countersunk openings in club shaft 22 may be tapped to threadingly receive bolts 26,27. The heads of bolts 26,27 are provided with conventional depressions therein (not designated) to receive a screw driver of other tool for tightening the bolts into nuts 28,29.

Figure 5:
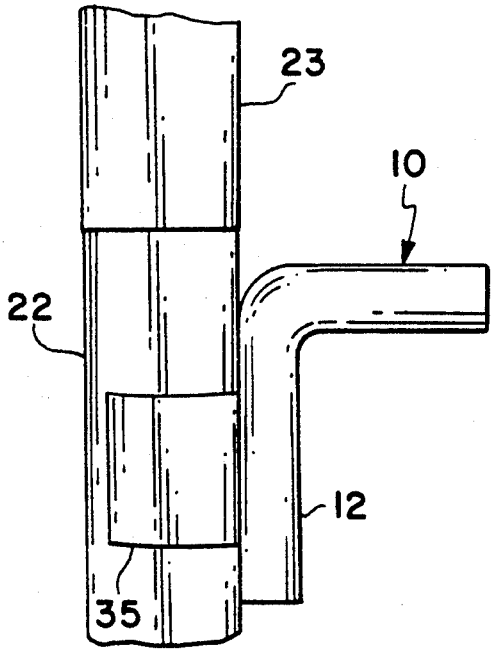
FIG. 5 is a view of another alternate attachment structure for releasably securing the attachment device to a golf club.
Figure 6:
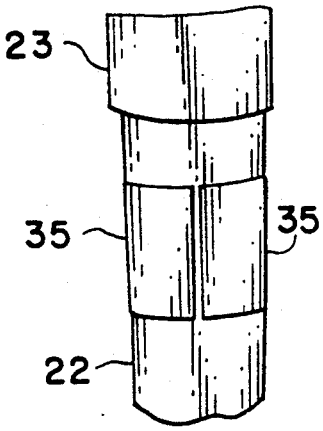
FIG. 6 is a view taken in the direction of arrow VI in FIG. 5.

Referring now to FIGS. 5 and 6, an alternate releasable connection for finger support attachment device 10 is illustrated. In this embodiment, a split spring sleeve 35 is welded or otherwise permanently secured to attachment device 10 and positioned around club shaft 22 adjacent handle grip 23. Split spring sleeve 35 is formed of thin spring steel and is easily forced open to permit positioning about shaft 22 and springs back for snug engagement of shaft 22 to prevent any undesirable slippage of attachment device 10 thereon. As illustrated in FIG. 6, the split ends of spring sleeve 35 are spaced apart when attachment device 10 is disposed on shaft 22. When removed from shaft 22, the split spring sleeve ends would be in contact or overlapping relationship with each other. This split spring sleeve releasable connection maintains attachment device 10 on shaft 22 secure enough to permit the entire weight of club 20 to be supported by a lifting force exerted on second cylindrical portion 14. However, the engagement of split spring sleeve 35 does permit forced movement, or slippage, of the secured finger support attachment device 10 to position attachment device 10 spaced from handle grip 23 when the golfer desires to employ a "choking" grip on putter 20. Thus, the split spring steel releasable securing structure 35 adds the vertical adjustable positioning feature for attachment device 10 along the length of shaft 22.

Figure 7:
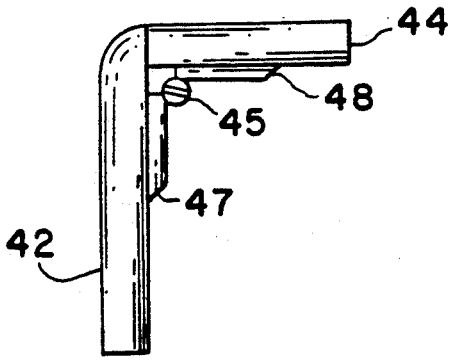
FIG. 7 is a view similar to FIG. 1 and illustrating a segmented and hinged embodiment of the golf club attachment device of the present invention when in the expanded use position.
Figure 8:
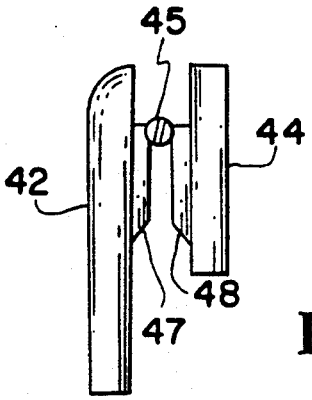
FIG. 8 is a view of the device shown in FIG. 7 when in the storage or non-use position.

Referring now to FIGS. 7 and 8, an alternate embodiment of finger support attachment device 10 is shown. In this embodiment, attachment device 10 is formed of two separate elongated cylindrical portions 42,44 hingedly connected by a hinge 45. Hinge 45 is releasably connected to the first and second cylindrical portions 44,45 by respective integral brackets 47,48 by suitable screws, or the like, (not illustrated) in a conventional manner. The unfolded or use position of attachment device 10 is shown in FIG. 7 and the folded or storage position of attachment device 10 is illustrated in FIG. 8. When folded, as in FIG. 8, attachment device 10 is compacted such that the putter releasable connected thereto may be placed within a conventional golf bag. When removed from the golf bag, attachment device 10 is unfolded to the position of use as shown in FIG. 7 Hinge 45 is similar in structure and function to conventional hinges employed on eye glass frames. The hinged embodiment of attachment device 10 illustrated in FIGS. 7 and 8 may be secured to a golf club shaft by any of the releasable connections described hereinbefore in reference to FIGS. 1-3, 4, and 5-6.

The operation and advantages of the invention are now believed apparent. The finger support attachment device 10 is releasably secured to a golf putter shaft 22 by any one of the releasable connections described and the club is ready for use. The club is grasped by the golfer such that an area of second cylindrical portion (14 or 44) of attachment device 10 rests in a portion of the groove of the first joint of the golfers index finger. The second cylindrical portion (14 or 44) is positioned between the golfers index and middle fingers with substantially the entire weight of the golf club being supported by the index finger. In contrast to flat metal, curved or cup-like designs, the cylindrical shape of first and second cylindrical portions 12 and 14 are sufficiently narrow to fit comfortably within the groove of the first joint when the index finger curls around shaft 22.

In a specific embodiment of the present invention attachment device 10 was constructed from solid cylindrical aluminum stock metal having a diameter of 5 mm and bent to provide first cylindrical portion of a length of 40 mm and second cylindrical portion having a length of 20 mm.

Although the invention has been described relative to specific embodiments thereof, it is not intended to be so limited. There are numerous modifications and variations of the present invention that will be readily apparent to those skilled in the art in the light of the above teachings. For example, although the invention has been illustrated and described for use with putters, it is not limited to putters and is equally applicable for use with pitching and chipping golf clubs. Further, in lieu of the releasably secured attachment devices described herein, the inverted "L" configured device could be formed integral with, and of the same material as, the club shaft during manufacture of the golf club, if so desired. Also, although the specific examples described herein were made from a specific diameter aluminum stock, the invention is not so limited. Other metals, polyvinylchloride and other plastics, as well as composite cylindrical rods, and having the same or different diameters, are also deemed useful for the construction of finger support attachment device 10 and are considered within the scope of the present invention. Thus, the specific embodiments, materials and sizes described herein are to be considered as illustrative only and are not to be deemed as exhaustive.

These and other modifications and variations of the present invention will be readily apparent to those skilled in the art in the light of the above teachings.

It is therefore to be understood that, within the scope of the appended claims, the invention may be practiced other than as specifically described herein.

What is claimed as new and desired to be secured by Letters Patent of the United States is:

1. In combination, a golf club and a finger engaging attachment for said golf club to assist the golfer in positioning and supporting key fingers on said golf club during the golf swing, comprising:

said golf club having an elongated shaft with a handle grip portion disposed at one end and a golf club head, including a ball engaging face, disposed at the other end thereof;

said finger engaging attachment having a first cylindrical portion disposed parallel with said golf club shaft and a separate second cylindrical portion rotatable from a first operative position parallel with said golf club head and extending transversely from and in the same vertical plane as that of said first cylindrical portion to a second inoperable position perpendicular to said golf club head and in parallel adjacency to said first cylindrical portion;

means for securing said first cylindrical portion to said elongated shaft;

said second cylindrical portion having parallel first and second flat ends;

hinge means connecting said first and said second cylindrical portions together;

said hinge means including a bracket connected to, in parallel relationship with and adjacent an end of, each said first and said second cylindrical portions;

said hinge means permitting rotative movement of said second cylindrical portion from a first operative position wherein said first flat end of said second cylindrical portion is in engagement with a surface of said first cylindrical portion and wherein said second cylindrical portion is disposed parallel with said golf club head, transverse to, and in the same vertical plane as that of said first portion; to a second and inoperative position wherein said second cylindrical portion is spaced from, parallel with said first cylindrical portion, and perpendicular to said golf club head, to facilitate storage, and insertion/removal of said golf club in a golf bag.

2. The finger engaging attachment of claim 1 wherein said means for securing said first cylindrical portion to the shaft of a golf club includes at least one screw extending transversely through said first cylindrical member and tapped into the shaft of a golf club to releasably secure said first cylindrical portion to the golf club shaft.

3. In combination, a golf club and a finger engaging attachment for said golf club;

said golf club having a head, a handle grip portion, and a shaft disposed between and connecting said head and said handle grip portion;

a golf ball engaging face on said golf club head;

said finger engaging attachment for said golf club having a first cylindrical portion parallel with and secured to said shaft and a second cylindrical portion extending perpendicularly from said first cylindrical portion, and disposed adjacent said handle grip portion and parallel with said golf ball engaging face on said golf club head;

said finger engaging attachment serving to assist a golfer using said golf club in positioning and supporting key fingers on said handle grip portion during the golf swing;

said first and said second cylindrical portions of said attachment device comprising separate structures;

said second cylindrical portion being provided with parallel first and second flat ends;

hinge means connecting said first and said second cylindrical portions;

said hinge means including a bracket connected in parallel relationship with, and adjacent an end of, each said first and said second cylindrical portions;

said hinge means permitting movement of said second cylindrical portion from an operative position wherein said second cylindrical portion is disposed perpendicular to said first cylindrical portion, said first flat end of said second cylindrical portion is flush with said first cylindrical portion, and said second cylindrical portion is disposed parallel with said golf ball engaging face on said golf club head, to a storage position wherein said second cylindrical portion is spaced from and parallel with said first cylindrical portion.

4. The combination of claim 3 including at least a pair of spaced, threaded bolts extending transversely through said first cylindrical portion of said finger engaging attachment and through said shaft, said shaft being provided with a pair of countersunk bores for receiving said pair of bolts and a nut for each member of said pair of bolts disposed within said countersunk bores.

* * * * *